United States Patent [19]

Marshall

[11] 4,095,007

[45] * June 13, 1978

[54] BIAXIALLY ORIENTED NONWOVEN FABRICS AND METHOD OF MAKING SAME

[75] Inventor: Preston F. Marshall, Walpole, Mass.

[73] Assignee: The Kendall Company, Boston, Mass.

[ * ] Notice: The portion of the term of this patent subsequent to Jul. 13, 1993, has been disclaimed.

[21] Appl. No.: 704,582

[22] Filed: Jul. 12, 1976

Related U.S. Application Data

[63] Continuation-in-part of Ser. No. 506,843, Sep. 17, 1974, Pat. No. 3,969,561.

[51] Int. Cl.[2] ..... B32B 5/12

[52] U.S. Cl. ..... 428/113; 428/114; 428/156; 428/167; 428/170; 428/171

[58] Field of Search ..... 428/113, 114, 156, 167, 428/170, 171, 293, 294, 295

[56] References Cited

U.S. PATENT DOCUMENTS

| | | | |
|---|---|---|---|
| 2,862,251 | 12/1958 | Kalwaites | 428/131 |
| 3,193,436 | 7/1965 | Kalwaites | 428/113 |
| 3,240,657 | 3/1966 | Hynek | 428/156 |
| 3,485,706 | 12/1969 | Evans | 428/134 |
| 3,681,184 | 8/1972 | Kalwaites | 428/156 |
| 3,682,756 | 8/1972 | Kalwaites | 428/156 |
| 3,969,561 | 7/1976 | Marshall | 428/113 |

*Primary Examiner*—William R. Dixon, Jr.
*Attorney, Agent, or Firm*—Edward J. Scahill, Jr.

[57] ABSTRACT

A nonwoven fabric having alternating stripes of high fiber density and low fiber density is made in such a manner that the high fiber density stripes run across the fabric and maximize the cross direction strength to a point that the cross direction/machine direction strength ratio approaches unity. This advantageous and desirable characteristic can be achieved by hydroforming a card web, by disposing the carded web on a relatively fine mesh screen and placing a finger-like striping bars over the web with the axis of the bars at 90° to the card web's general fiber orientation. Water was then sprayed over the assembly with sufficient force to rearrange the fibers in the web thereby producing the nonwoven fabric of this invention.

5 Claims, 8 Drawing Figures

BIAXIALLY ORIENTED NONWOVEN FABRICS AND METHOD OF MAKING SAME

This is a continuation-in-part of my co-pending patent application U.S. Ser. No. 506,843 filed Sept. 17, 1974, now U.S. Pat. No. 3,969,561 issued on July 13, 1976.

BACKGROUND OF THE INVENTION

For years, the nonwoven industry has attempted to produce a carded nonwoven fabric that has good cross direction strength. Generally, the fibers in carded webs are aligned in a direction substantially parallel to the direction of the web within the carding machine normally used to make nonwoven fabrics. Consequently, the machine direction strength of a carded web generally is a high multiple of the cross direction strength. A further complication is that the conventional processing of bonded nonwoven fabrics consists of a set of stages—conveying, saturating, drying, winding, etc.—all of which impose a further drafting and parallelizing effect on the fibrous web. In this "normal" multi-stage bonding operation, tensile strength ratios will be found which are 10 to 20 to 1, machine direction to cross direction strengths.

Attempts to bring the so-called MD/CD ratio closer to 1 have included the use of a cross-laying device, whereby a full-width web of oriented fibers is mechanically pleated back and forth across a conveyor belt to build up a composite batt in which the average angular displacement of the fibers is alternated. Such devices are slow, cumbersome and are suitable only for batts of substantial thickness where fold marks and overlap ridges are not objectionable.

Another expedient used in the prior art to achieve better tensile strength ratios is to disperse the fibers in more or less random orientation into an air stream, from which they are collected on a conveyer screen with the aid of suction. Such devices, however, are expensive, and while satisfactory at speeds of around 10 yards per minute, they produce webs of poorer quality at speeds of over 15 yards per minute, due to clumping and poor dispersion of fibers.

It is with improvements in the art of producing fibrous webs and nonwoven fabrics of more nearly equalized machine (longitudinal) direction and cross (lateral) direction tensile strengths, as well as producing aesthetically pleasing and different nonwoven fabrics, that this invention is concerned.

Accordingly, it is an object of the present invention to produce a nonwoven fabric, initially made from a carding machine, that has an MD/CD strength ratio that approaches unity.

It is another object of this invention to produce an aesthetically different and pleasing nonwoven fabric that has this advantageous strength characteristic.

Still another object of this invention is to provide apparatus and a method of making a carded nonwoven fabric that has an MD/CD ratio that approaches unity.

SUMMARY OF THE INVENTION

A carded nonwoven fabric is produced to have a cross direction/machine direction strength ratio that approaches unity. This advantageous web has alternate stripes of high fiber density and low fiber density that is made in such a manner as to have the high fiber density stripes run across the fabric. A carded web disposed on a relatively fine mesh screen has finger-like striping bars placed over the web with the axis of the bars disposed at approximately 90° to the carded web's fiber orientation. A hydroforming process, wherein water is sprayed over the assembly, rearranges the fibers in the web. The fibers in the low fiber density areas have their fibers straight and highly oriented in the machine direction so as to maximize the MD strength per unit of fabric weight in the light or low fiber density area. By drawing the fibers very straight in these low density stripes, more of the individual fiber's length is available for folding into fiber segments lying in the cross direction in the high fiber density stripes. These fiber segments that are hydraulically moved from the low fiber density areas to the high fiber density areas are accordian folded, resulting in a higher CD orientation of the fiber segments in the high density areas than was present in the original web. The resulting nonwoven fabric advantageously has, not only good aesthetic appeal but, a nearly equal cross direction strength and machine direction strength.

DESCRIPTION OF THE PREFERRED EMBODIMENTS

Figure 1:
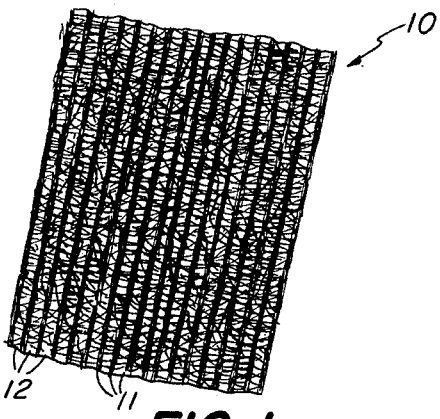
FIG. 1 shows a plan view of a portion of the biaxially oriented nonwoven fabric of this invention.

A nonwoven fabric 10 has alternating stripes of high fiber density areas 11 and low fiber density areas 12, as shown in FIG. 1. A majority of the fibers in the high fiber density stripes 11 are rather uniformly distributed therein and are oriented in a direction substantially parallel with the contours of the stripes, and a majority of the fibers in the low fiber density areas 12 that lies directly adjacent the high fiber density areas 11 are substantially uniformly distributed therein, and are oriented in a direction substantially normal to the axis of the stripe. Such a nonwoven material is described in my earlier application, U.S. Ser. No. 506,843, filed on Sept. 17, 1974, of common assignee, now U.S. Pat. No. 3,969,561 issued on July 13, 1976.

This fabric has particularly good hand and feel, as well as a very high aesthetic appeal to those skilled in the art. However, like other nonwoven products, this material has a rather high tensile strength ratio in favor of the machine direction strength.

U.S. Pat. No. 2,862,251 describes a method and apparatus for producing foraminous fabrics. This patent describes a method and apparatus for using fluid forces to rearrange a layer of fibrous material into a foraminous unitary nonwoven fabric structure comprising spaced interconnected packed fibrous portions of starting material and openings or apertures arranged in a predetermined pattern which are separated by the interconnected packed portions. A layer of starting material having individual fibrous elements which are capable of movement under the influence of an applied fluid force is positioned between rigid means having apertures thereon and a tensioned screen having foramina thereon that are smaller than the apertures. A stream of water, from a jet spray, or the like, is then caused to flow through the web thereby rearranging the individual fibrous elements into a patterned, apertured nonwoven web.

It has now been discovered that an aesthetically pleasing, striped nonwoven fabric can be made from a carded web to have a machine direction to cross direction tensile strength ratio that approaches unity. A carded web or a cross stretched carded web is passed through an apparatus quite similar to that described in U.S. Pat. No. 2,862,251; however, instead of positioning the fibrous web between the apertured rigid means and the tensioned screen, the carded web is placed between a tensioned screen and a drum having spaced-apart striping bars disposed thereon. Thus, when streams of a fluid, such as water, are passed through the thusly positioned web, the fluid forces push the ends of the fibers located between the striping bars to the area under the bars, thereby causing the fibers in these newly formed low fiber density areas to be drawn very straight. Simultaneously, when this action takes place, the fiber segments that are hydraulically moved from the thin or low fiber density sections to the thicker or high fiber density sections are accordian folded when pushed together by forces on either side of a striping bar, thereby resulting in a higher cross direction orientation of the fiber segments in the high fiber density areas than was present in the original carded web. Accordingly, a fabric is produced having the high-fiber density stripes running across the fabric to maximize the cross direction strength.

Figure 2:
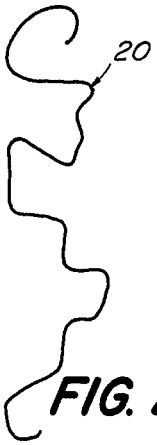
FIG. 2 shows a plan view of a normal textile fiber in its relaxed state.
Figure 3:
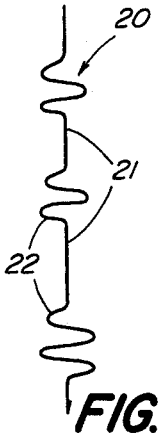
FIG. 3 shows a plan view of the fiber shown in FIG. 2 after being rearranged by fluid forces as described in this invention.
Figure 4:
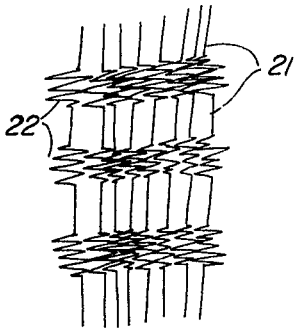
FIG. 4 shows a portion of a nonwoven fabric of this invention, wherein the fibers of the web are alternatingly drawn straight and accordian folded.

FIGS. 2, 3 and 4 show, in an exaggerated manner, how the fluid forces act on an individual fiber. For example, FIG. 2 shows a normal individual fiber 20 as being a series of cursive twists and turns, and having substantially no "straight" areas therein. However, FIG. 3 simulates in an exagerrated manner what the same fiber might look like after being subjected to the fluid forces with the striping bars used in this invention, wherein the fiber segments between striping bars used herewith are drawn straight, such as at 21, while the portions of the fiber above the striping bars become pushed together in an accordian fold, as shown by 22. Therefore, as shown in FIG. 4, the fibers 21 in the low fiber density areas have their fibers straight and highly oriented in the machine direction of the carded web so as to maximize the MD strength per unit of fabric weight in the low fiber density areas, while the fiber segments 22 in the high fiber density areas are accordian folded resulting in a higher CD orientation—the MD/CD strength ratio thereby comes close to unity.

The cross direction strength can be further enhanced when an overall saturation binder technique is then used on the web. For example, when binder is added to the still wet web, and suction is applied to remove excess binder, a majority of the binder in the low fiber density areas passes through the web. Consequently, more binder is present in the thick or high density areas than in the low fiber density areas, thereby producing a further enhancement of the CD strength.

Of course, striping bars of varying widths can be used, and the number of striping bars per inch can be varied while still producing the novel nonwoven fabric of this invention. This is shown in the examples outlined herein.

It should be noted that fibers or fiber segments forced to lie in a narrow band or stripe must become increasingly oriented along the axis of that stripe as the stripe width decreases. For example, in a hypothetical stripe of only a few fiber diameters width, any fiber segment of reasonable length would be forced into a cross-direction orientation of absolute precision with its axis only a few fiber diameters in variation from a straight line. While this example may be difficult to produce, it does demonstrate this geometric principle.

Figure 5:
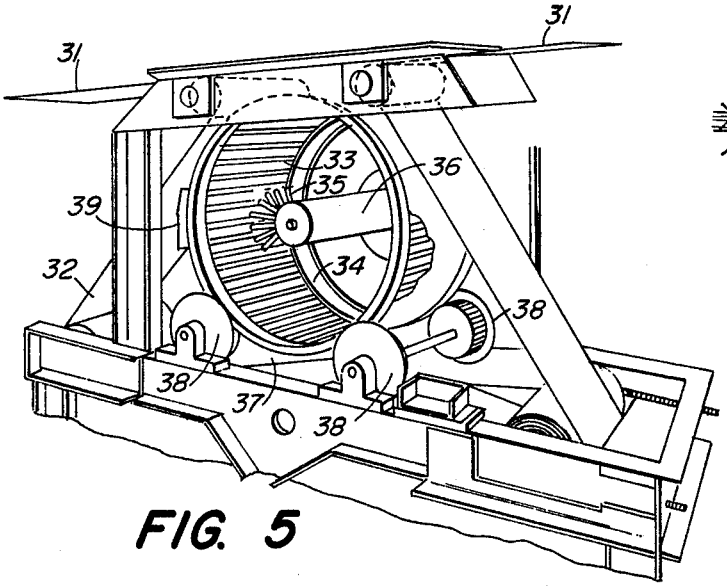
FIG. 5 shows a perspective view of the apparatus of this invention that is used to produce the nonwoven fabric of this invention.
Figure 6:
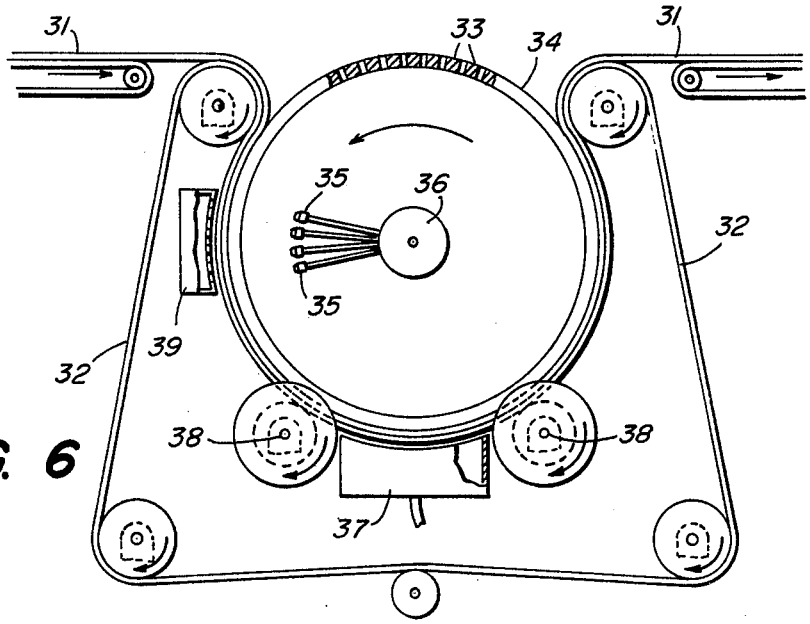
FIG. 6 shows a side view of the drum and hydroforming portion of the apparatus shown in FIG. 4.

As mentioned earlier herein, the actual production of this fabric can be made with apparatus described in U.S. Pat. No. 2,862,251. However, instead of the foraminous drum having apertures thereon, a drum has been made having striping bars thereacross. FIGS. 5 and 6 show a carded web 31 being sandwiched between a tensioned screen 32 and the striping bars 33 disposed on the drum 34. Fluid jets, such as water jets 35, are mounted on shaft 36 so that as the carded web 31 passes through this sandwich it is hit by the jets of water in a striking zone in a manner that rearranges the fibers in the web as described herein above. As the fluid force passes through the thusly positioned web, it pushes the fibers located between the striping bars to the area under the bars, thereby causing the fibers in these newly formed low fiber density areas to be drawn very straight, being pulled in opposite directions toward the adjacent high fiber density areas under the bars. At the same time, when this action takes place, the fiber segments that are hydraulically moved from the low fiber density areas to the high fiber density areas become somewhat accordian folded, thereby resulting in a higher cross direction orientation of the fiber segments in the high fiber density areas than was present in the original carded web.

The drum 34, cradled as by freely moving rollers 38, can then carry the thusly treated web past suction box 37, which further aids in rearranging the fibers in the web as well as removing the excess water therefrom. A suction box 39 can also be positioned directly behind the drum at the point where the water is being passed through the striping bars, web and screen. Of course, it is not necessary to use water as the fluid force; other fluids such as gas or air or the like can be used with similar although possibly somewhat less desirable results. For example, if the web contains a proportion of thermoplastic fibers therein, then it might be desirable to use live steam as the fluid to rearrange the fibers, thereby producing a thermoplastic bonded fabric at the same time as the rearrangement of the web takes place.

The fluid force exerted by the water jets or nozzles should preferably produce a water flow rate of approximately 10cc/sec per inch of width per bank of nozzles, using 6 banks of nozzles. The nozzles can be conventional solid cone nozzles in overlapping relation, such as used and described in U.S. Pat. No. 2,862,251. Also, the water pressures and delivery capabilities can be as described in the above-mentioned patent. However, when this system is used with the striping bar apparatus described above, a pulling action is exerted on the fibers in the low density areas between the bars, while the above-described accordian folding action takes place simultaneously under the bars. This is opposed to the results achieved and described in U.S. Pat. No. 2,862,251, wherein uniformly apertured fabrics are formed having spaced interconnected packed fibrous portions of starting material and apertures arranged in a predetermined pattern which are separated by interconnected packed portions in yarn-like bundles. The difference in fiber structure achieved above unexpectantly results in a much stronger fabric in all directions—i.e., a nonwoven fabric possessing a tensile strength ratio that approaches unity.

Figure 7:
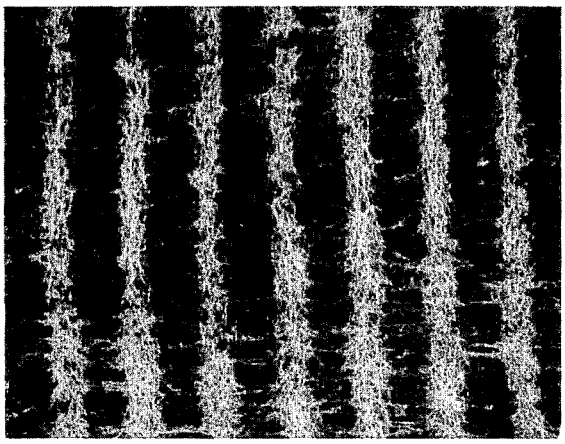
FIG. 7 shows a photograph of one of the fabrics made in this invention.

FIG. 7 shows a photograph of the striped fabric of this invention. As can be observed in this photograph, the low fiber density areas have a majority of its fibers drawn relatively straight between the high fiber density stripes. While in the high fiber density stripes, the "accordian folds" are not as pronounced as in FIG. 3, it is urged that this is the mechanism taking place in those stripes that gives the particular fiber orientation described. Furthermore, although "apertures" are present in the web, they appear in a random fashion thereon and are not surrounded by yarn-like bundles of fibers.

The following are illustrative examples of fabrics produced with this invention:

EXAMPLE I

A carded web weighing 12.28 gms/sq. yrd. was made in the conventional manner using 3 denier 1 9/16 inches type 40 FMC rayon fibers. The MD/CD tensile strength ratio of such webs is over 10 to 1. The carded web is then put through the apparatus described above wherein the striping bar mechanism is made of ⅛ inch wide metal striping bars that are positioned on the drum on ¼ inch centers. The web is hit with water droplets having a flow rate of approximately 10cc/sec per inch of width per bank of solid cone type spray nozzles using six banks of nozzles. The web continues on the drum, is suctioned to remove excess water, and is then overall saturated with HA 8 binder (tradename for an acrylic binder composition sold by Rohm & Haas). The resulting striped nonwoven fabric would have a machine direction tensile strength of 1.95 pounds per inch of width and a cross direction tensile strength of 1.15 pounds per inch of width—an MD/CD ratio of about 1.7 to 1. This is an improvement in the strength ratio over the carded web of 5.84 times.

EXAMPLE II

A carded web weighing 20 grams/sq. yd. was prepared in the same manner and of the same fiber material as that previously described in the above example. Again, the MD/CD ratio of this material being in excess of 10 to 1. This web was treated in the same manner as in Example I and under the same conditions, also using the HA 8 binder. The resulting striped fabric would have a machine direction tensile strength of 2.4 pounds per inch of width and a cross direction tensile strength of 2.1 pounds per inch of width—an MD/CD ratio of about 1.14 to 1. This is an improvement in the strength ratio over the carded web of more than eight times.

Figure 8:
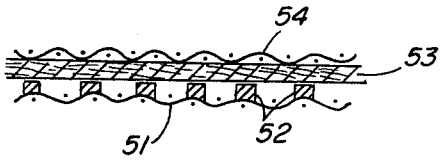
FIG. 8 shows a sectional view of the nonwoven web of this invention between a tensioned screen and another screen having the striping bars as an integral part thereof.

Although all the figures and discussions for making the nonwoven fabric of this invention utilize a drum having fairly rigid striping bars thereon, FIG. 8 shows another embodiment of the apparatus used to make this fabric. A tensioned screen 54 serves as a backing for web 53. The web is sandwiched between screen 54 and another screen 51 having striping bars 52 as an integral part thereof. These striping bars 52 can either be imprinted on the screen or woven into the screen. If the water spray enters from direction A, then you will still have the same action as described above herein with the drum. However, if the water spray enters from direction B, then the fibers will be washed away from the impervious striped areas 52 and into the open areas between the stripes—this is the reverse of our previous discussion and examples.

In addition to the obvious advantage of increased strength ratios in the fabric of this invention, it should also be pointed out that due to the structure of the fabric (i.e., alternating stripes of high and low fiber density) the low fiber density stripes act as "hinges" of a sort thereby greatly enhancing the feel and drape of the fabric.

While it is described in the two examples that the web is made of rayon fibers, it should be pointed out that any other fibers used by those skilled in the art of nonwoven fabrics could also be utilized in this invention. For example, as described herein earlier, thermoplastic fibers could be used in forming the web and could later be subjected to live steam to bind the web and rearrange the fibers simultaneously. Further, a carded web could be made from continuous filaments of reshuffled spread tow web and could also be utilized in this process with similar results.

The water pressures and flow rates mentioned herein are preferred, however, it is possible to use pressures in the range of 20 PSIG to 10,000 PSIG. For example, high pressure water streams can be used, as described in U.S. Pat. No. 3,485,706 to produce these striped fabrics. These pressures range up to 5,000 pounds per square inch gage. The striped fabric produced thereby will not require any further bonding agents, while still having an MD/CD that approaches unity.

In the description of this invention, it has been stated that a carded web is used as a starting material, however, if a CD strength that is higher than the MD strength is the desired end product, then a random web can be used initially and will result in a nonwoven that has an MD/CD ratio of less than one.

It should also be noted at this time that a cross-stretched carded web could be used with similar and perhaps more advantageous results.

It is obvious that many modifications and embodiments can be made in the above-described invention without changing the spirit and scope of the invention; for example, as noted above, a screen with impervious striping bars woven into or imprinted on the screen could be used instead of striping bars over the web. However, it is intended that this invention not be limited by anything other than the appended claims.

What is claimed is:

1. In a biaxially oriented nonwoven fabric of fibers having adjacent and alternating striped areas of low fiber density and areas of high fiber density, a majority of the fibers in said low fiber density areas being uniformly distributed therein and oriented in a direction substantially normal to the axis of the striped area and, a majority of the fibers in the high fiber density area that lies directly adjacent to low fiber density areas being uniformly distributed therein and oriented in a direction substantially parallel with the stripes of the low fiber density area, the improvement comprising a majority of the fibers in said low fiber density area are pulled straight thereacross, while a majority of the fibers in said high fiber density area are accordian folded in a manner as to have the fiber segments therein aligned substantially parallel to each other; said fabric having a machine direction to cross direction tensile strength ratio of less than 2 to 1.

2. The fabric of claim 1 wherein said fibers are rayon fibers.

3. The fabric of claim 1 wherein said fibers include a proportion of thermoplastic fibers.

4. The fabric of claim 1 wherein said stripes are approximately $\frac{1}{8}$ inch wide on approximately $\frac{1}{4}$ inch center.

5. The fabric of claim 1 wherein said machine direction to cross direction tensile strength ratio is less than 1.

* * * * *